United States Patent [19]

Wier

[11] 4,392,282

[45] Jul. 12, 1983

[54] LOCK FOR SAFETY BELTS

[75] Inventor: Franz Wier, Göggingen, Fed. Rep. of Germany

[73] Assignee: REPA Feinstanzwerk, Alfdorf, Fed. Rep. of Germany

[21] Appl. No.: 240,154

[22] Filed: Mar. 3, 1981

[30] Foreign Application Priority Data

Mar. 4, 1980 [DE] Fed. Rep. of Germany ..... 3008298

[51] Int. Cl.[3] ..... A44B 11/16

[52] U.S. Cl. ..... 24/230 AL

[58] Field of Search ..... 24/230 A, 230 AL

[56] References Cited

U.S. PATENT DOCUMENTS 4,004,115 1/1977 Esner ..... 24/230 AL 4,237,586 12/1980 Morinaga ..... 24/230 A

*Primary Examiner*—Hugh R. Chamblee

*Attorney, Agent, or Firm*—Herbert L. Lerner; Laurence A. Greenberg

[57] ABSTRACT

Lock for a safety belt having a belt lock and a plug-in tongue which can be locked in position by a latch movable by a manual pressure element transversely to the plug-in tongue direction to the opening position. The latch is retained by a force, preferably a spring-loaded ejector, in the opening position. When a pulling force exceeding a predetermined value acts on the plug-in tongue, an insertion lock in the belt lock permits withdrawal of the tongue but prevents a renewed insertion of the tongue.

16 Claims, 5 Drawing Figures

LOCK FOR SAFETY BELTS

BACKGROUND OF THE INVENTION

1. Field of the Invention

The invention relates to a lock for safety belts with a belt lock and a plug-in tongue which can be locked in position by a latch which can be moved to the opening position transversely to the plug-in direction by a manual pressure element, or by the plug-in tongue, whereby the spring-loaded latch, preferably by a spring-loaded ejector, is retained in the opening position.

2. Description of the Prior Art

In the known safety belt systems, the plug-in tongue, which is fastened to the free belt-end, is inserted into a belt lock which directly or indirectly is secured by a fitting, for example, on the floor of the vehicle. The plug-in tongue is locked in position in the lock by means of a latch. The latch is detented by spring force behind a locking edge of the plug-in tongue, and can be moved from the locked position to the open position by a pressure element which can be operated manually, for example, a pressure button, so that the plug-in tongue can be pulled out from the belt lock at all times. Conventionally, a spring loaded ejector is provided, which, when the tongue is inserted elastically, presses onto the end of the tongue, and ejects the plug-in tongue after the latch has been moved. Simultaneously, the latch is held in the open position, so that the tongue can, without obstructions be inserted into the belt lock to the detent position, when the belt is used the next time, and the tongue can be locked again. This makes it obligatory, that after an extreme stress on the safety system, for example, after a crash, to replace the safety system, because the reliability of the safety function of the overstressed system is no longer assured.

SUMMARY OF THE INVENTION

An object of the invention is to provide a lock for a safety belt of the above-described type which, after an extreme mechanical stress of the belt system will make continued further use not possible.

With the foregoing and other objects in view, there is provided in accordance with the invention a lock for a safety belt comprising a belt lock with spaced plates defining an insertion path, a plug-in tongue for insertion in the insertion path, a latch movable transversely to the insertion path to the locked position in which the latch is interposed in the path of the tongue and to the open position in which the latch does not block passage of the tongue in the insertion path, a manually operated pressure element to move the latch from the locked position to the open position, spring means retaining the latch in the open position when the tongue is withdrawn from the insertion path, an insertion lock in the belt lock activated by a pulling force on the plug-in tongue exceeding a predetermined value to restrain said spring means to permit withdrawal of the tongue from the insertion path and prevent renewed insertion after such withdrawal.

Other features which are considered as characteristic for the invention are set forth in the appended claims.

Although the invention is illustrated and described herein as embodied in a lock for safety belts, it is nevertheless not intended to be limited to the details shown, since various modifications may be made therein without departing from the spirit of the invention and within the scope and range of equivalents of the claims.

BRIEF DESCRIPTION OF THE DRAWINGS

The invention, however, together with additional objects and advantages thereof will be best understood from the following description when read in connection with the accompanying drawings, in which:

In FIG. 1 the lock is in open position. In FIG. 2 the lock is in locked position. In FIG. 3 the ejector is restrained by a locking member and the tongue is blocked by the latch and cannot be inserted.

DETAILED DESCRIPTION OF THE INVENTION

Figure 1:
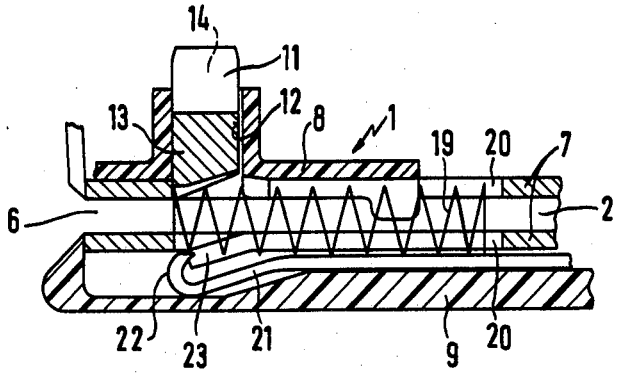
FIGS. 1–3 shows a lock for safety belts according to the invention in a simplified sectional view, in three different operating positions.

An insertion lock in the belt lock permits operation to withdraw the tongue after a pulling force exceeding a predetermined value acts on the plug-in tongue, and prevents renewed insertion after the tongue has been pulled out. The pulling force applied by the plug-in tongue on the belt lock is utilized, according to the invention, to operate an insertion lock in such a manner that, though the tongue can in the conventional manner be withdrawn from the belt lock, i.e. the safety belt system can be opened, a renewed insertion of the tongue into the belt lock is made impossible. Preferably, the insertion lock is so constructed, that after an extreme mechanical stress it prevents the blocking of the latch in the opening position, so that the latch by spring action falls again into the lock position without the plug-in tongue being inserted into the belt lock. Preferably, relative motion is utilized which takes place at an extreme load between the belt lock and a connecting element which connects the belt lock with a fitting, for example, in the form of a rivet or pin.

A locking member is used as the insertion lock which by obstruction or restraint prevents the latch from being held or retained in the opening position. By the above mentioned relative motion the element effecting the blocking or the latch to retain it in open position, for example, the ejector, is restrained from performing its blocking function.

It is especially advantageous to use as the locking member a hook-shaped, elastic element, which, when the relative motion occurs by its own spring action, and/or by moving up on a curved path or surface of the belt lock housing, is moved into the slide-path of the release element, and possibly also of the pressure element, for example, of the pressure button. The locking member in the non-operating or rest position, bears on a stop which is part of the housing, and after operating, i.e. actuation, falls in a detent opening of the housing. The locking member in the detent opening blocks the release means in the opening position, and is prevented by the boundary edge of the detention opening from returning to the rest position or to be moved to the latter.

The latch is partly moved to the opening position by the pressure element, for example, the pressure button, and otherwise is automatically moved outside of the insertion path by the plug-in tongue as it is pushed out of the belt lock. Hereby, it is assured by the combined action with the mentioned locking member for the ejector, that it is impossible, after the latch has again dropped into the lock position with the tongue withdrawn, to move the latch again completely into the opening position, even by also operating the pressure element. The latch remains in the lock position even if the latch is slightly lifted. A special device for locking, or blocking of the pressure element is not necessary.

Last but not least, by virtue of the invention, the possibility exists that, based on the actual position of the insertion lock, or of the locking member, after an extreme mechanical stress, one can make deductions with respect to the magnitude of the previous stress, and thereby, with respect to the seriousness of the accident, a feature of special importance in the investigation of accidents.

Further advantageous details of the invention are explained with the aid of the typical embodiment shown in the drawings and described in the following.

Figure 2:
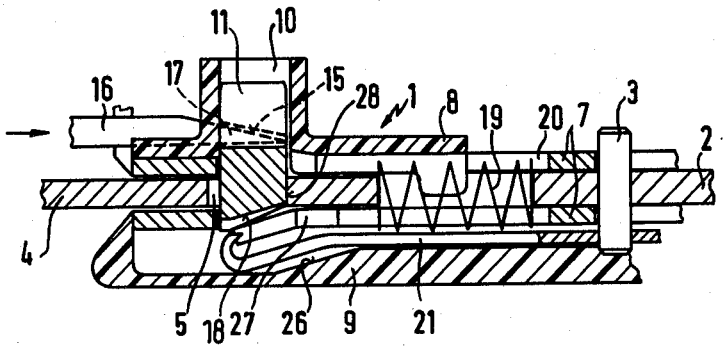
Figure 3:
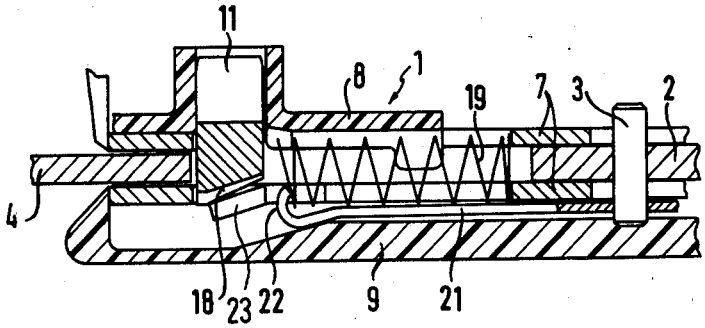
Figure 5:
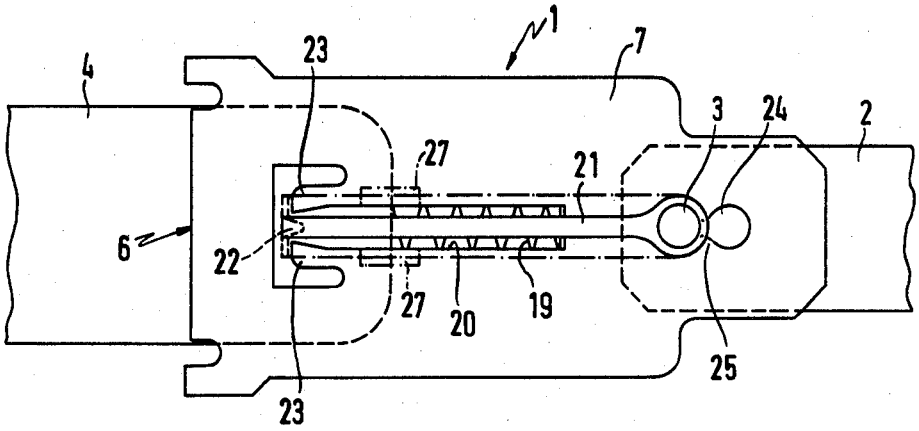
FIG. 5 is a plan view onto the bottom (under)side of the lock according to the FIGS. 1–3.
Figure 4:
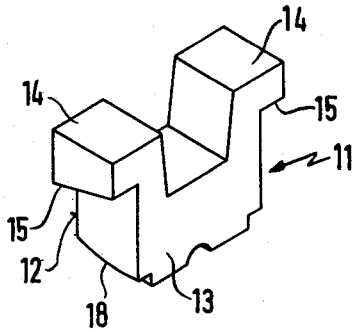
FIG. 4 is a perspective representation of the latch used in the lock according to the invention.

In the embodiment, a belt lock designated as a whole by numeral 1, is fastened by a connecting element 3 in the form of a pull-rod and a rivet to the floor of the vehicle, which is equipped with the safety belt system. A plug-in tongue 4 with a detent opening 5 is secured to the free belt end. The plug-in path or path of insertion 6 of the belt lock 1 is bounded by two parallel plates 7. A belt-lock housing 8 is made, for example, of plastic. A housing part 9 can be attached to the plates 7. The belt lock housing 8 has a guide 10 which is perpendicular to the plug-in path 6, in which guide the latch 11 is retained—the latch is in detail shown in FIG. 4—and can slide transversely to the plug-in path 6 through corresponding openings in the plates 7. The latch 11 is essentially T-shaped in the form of a block, and has a locking edge 12 at a block-shaped projection 13; and also two oppositely directed shoulders 14 with slanted surfaces 15. As shown in FIG. 2, a pressure element 16 is, slideably in the direction of the arrow, supported in the belt lock housing 8. The pressure button with two fork-like and slanted projections 17, engages under the shoulders 14 of the latch 11, and by the motion in the direction of the arrow lifts the latch 11 from the position in FIG. 2 to such height that the contact-slant 18 on the latch 11 rises into the region of the forward locking edge 28 of the plug-in tongue 4. When the tongue is pulled out of the belt lock 1, the slanted surface 18 is automatically moved into the open position according to FIG. 1, in which position, as FIG. 1 shows, the latch 11 is held and blocked by ejector 19 which is constructed in the form of a pressure spring, or the latch is blocked by the forward spring windings of ejector 19. The pressure spring forming the ejector 19 bears at the pull rod 2 and is guided in grooves 20 in the plates 7 (see also FIG. 5). A leafspring-like locking member 21 is fastened at one side to the rivet 3, and at the other side is provided with a hook 22. As can be learned from FIG. 5, in conjunction with the FIGS. 1 to 3, the lower plate 7 has two slanted stop lugs 23, on which the latch 11 rests with its contact-slant 18 in the lock position, and on which the locking member 21 in the non-operative position can bank, if the locking element is wider than the width of the groove 20, see dotted lines in FIG. 5. Also, if the locking member 21 is not as wide as the groove 20, the end of the leaf spring 21 can bear on the stop-lugs 23 which are bent toward each other. As further shown in FIGS. 1–3 and 5, the plates 7 have a slot-like guide for the rivet in the form of a figure 8 which in the embodiment has a contraction 25. At the occurrence of a pull-force on the plug-in tongue 4 which exceeds a predetermined measure, i.e. in the case of a crash, the belt lock 1, including the tongue 4, is moved relatively with respect to the connecting element 3 and the pull rod 2 in the guide 24, from the position according to FIG. 2 into the position according to FIG. 3, whereby at the contraction 25, pin or rivet material is displaced corresponding to a controllable, predetermined force.

Because the locking member 21 is coupled to the connecting element 3, the latter is also moved with respect to the belt lock 1 along a curved path 26 of the housing part 9. According to FIG. 3, the locking member 21 gets by this curved path and also by its own elasticity into the slide path of the ejector 19, where the hook 22 grabs the forward spring coil of the ejector 19, and thereby blocks the latter. During this relative motion the hook-shaped end of the locking member 21, indicated in FIG. 5 by dot-dashes can drop into a detent opening 27, also indicated by dot-dash lines, whereafter it becomes impossible to move the locking member 21 back. After the described operation of the locking member 21, and the blocking of the ejector 19, the plug-in tongue 4 can be pulled out of the belt lock 1 in the normal manner by operating the pressure element 16. Thereafter, the latch 11 falls again by spring action into the lock position according to FIG. 3, because the blocking of the latch 11 in the opening position according to FIG. 1 is prevented by the activated insertion-lock. Thereby, it becomes impossible to insert the plug-in tongue 4 again into the strained belt lock 1. The safety belt system, at least its belt lock, must therefore be replaced.

I claim:

1. Lock for a safety belt comprising a belt lock with spaced plates defining an insertion path, a plug-in tongue for insertion in the insertion path, a latch movable transversely to the insertion path to the locked position in which the latch is interposed in the path of the tongue and to the open position in which the latch does not block passage of the tongue in the insertion path, a manually operated pressure element to move the latch from the locked position to the open position, spring means retaining the latch in the open position when the tongue is withdrawn from the insertion path, and an insertion lock in the belt lock activated by a pulling force on the plug-in tongue exceeding a predetermined value to restrain said spring means to permit withdrawal of the tongue from the insertion path and prevent renewed insertion after such withdrawal.

2. Lock according to claim 1, wherein the belt lock is connected to a fitting by a connecting element, and wherein said pulling force on the plug-in tongue exceeding a predetermined value causes relative motion between the belt lock and the connection element which activates said spring force.

3. Lock according to claim 1, wherein said spring means is a spring-loaded ejector.

4. Lock according to claim 2, wherein said spring means is a spring-loaded ejector.

5. Lock according to claim 2, wherein said insertion lock has a locking member which is connected with the connecting element, and wherein said locking member at a relative motion with respect to the belt lock due to said pulling force exceeding a predetermined value, restrains said spring means to permit withdrawal of the tongue and prevent renewed insertion.

6. Lock according to claim 4, wherein said insertion lock has a locking member which is connected with the connecting element, and wherein said locking member at a relative motion with respect to the belt lock due to said pulling force exceeding a predetermined value, restrains said spring means to permit withdrawal of the tongue and prevent renewed insertion.

7. Lock according to claim 5, wherein said locking member moves by said relative motion in the plug-in direction along a curved guide in said insertion lock.

8. Lock according to claim 7, wherein said locking member moves into the path of the ejector.

9. Lock according to claim 7, wherein said locking member moves into the path of said pressure element.

10. Lock according to claim 7, wherein the locking member is designed as a hook-shaped leaf spring which can move into the slide path of the ejector.

11. Lock according to claim 10, wherein the locking member has a hook-like part, and wherein the hook-like part catches a stop arranged outside of the insertion path when the locking member is in the rest position, and wherein a distance from the stop, is a detention opening for catching the hook-like part of the locking member when it is activated.

12. Lock according to claim 11, wherein the ejector is constructed in the form of a pressure spring, and wherein the locking member can with its hook-like end hook into a winding of the ejector.

13. Lock according to claim 1, wherein the latch has a contact-slant surface pointing toward the locking-edge of the tongue, whereby when the latch is only partly moved into the opening position by the pressure element, the tongue pressing against the slant surface completes moving the latch into the opening position.

14. Lock according to claim 5, wherein the connecting element between the belt lock and the fitting is a rivet, and wherein the locking member is coupled with the rivet.

15. Lock according to claim 9, wherein the belt lock has a slot-like rivet guide in the direction of belt insertion, in which guide the rivet is retained until a predetermined pulling force occurs, and after exceeding of this force can slide therein.

16. Lock according to claim 9, wherein the fitting has a slot-like rivet guide in the direction of the belt insertion, in which guide the rivet is retained until a predetermined pulling force occurs, and after exceeding of this force can slide therein.

* * * * *